US012252938B2

(12) United States Patent
Wollum

(10) Patent No.: US 12,252,938 B2
(45) Date of Patent: Mar. 18, 2025

(54) WORK PLATFORM AND METHOD FOR WELL OPERATIONS

(71) Applicant: Vestre Platå Invest AS, Sandnes (NO)

(72) Inventor: Vidar Wollum, Jørpeland (NO)

(73) Assignee: VESTRE PLATÅ INVEST AS, Sandnes (NO)

( * ) Notice: Subject to any disclaimer, the term of this patent is extended or adjusted under 35 U.S.C. 154(b) by 192 days.

(21) Appl. No.: 17/905,563

(22) PCT Filed: Mar. 3, 2021

(86) PCT No.: PCT/NO2021/050055
§ 371 (c)(1),
(2) Date: Sep. 2, 2022

(87) PCT Pub. No.: WO2021/177836
PCT Pub. Date: Sep. 10, 2021

(65) Prior Publication Data

US 2023/0086326 A1 Mar. 23, 2023

(30) Foreign Application Priority Data

Mar. 3, 2020 (NO) ..... 20200252

(51) Int. Cl.
*E21B 15/00* (2006.01)
*E21B 7/02* (2006.01)
(Continued)

(52) U.S. Cl.
CPC ..... *E21B 15/003* (2013.01); *E21B 7/023* (2013.01); *E21B 15/00* (2013.01); *E21B 19/00* (2013.01); *E21B 19/168* (2013.01)

(58) Field of Classification Search
CPC ..... E21B 15/003; E21B 7/023; E21B 15/00; E21B 19/00; E21B 19/168; E21B 17/20; E21B 17/00; E21B 19/22
See application file for complete search history.

(56) References Cited

U.S. PATENT DOCUMENTS 3,033,527 A * 5/1962 Hart ..... E21B 15/00 52/645
5,244,046 A 9/1993 Council
(Continued)

FOREIGN PATENT DOCUMENTS

NO 20140734 A1 12/2015
NO 338538 B1 * 9/2016 ..... E21B 15/00
(Continued)

OTHER PUBLICATIONS

Norwegian Oil and Gas Handbook for Safe Handling of Wireline Equipment on Deck, Norwegian Oil and Gas Association, Jan. 3, 2019. (Year: 2019).*
(Continued)

*Primary Examiner* — Robert E Fuller
(74) *Attorney, Agent, or Firm* — Kilpatrick Townsend & Stockton LLP

(57) ABSTRACT

A work platform (10) for use in well operations, the work platform (10) being configured for positioning above a well pipe (15), the work platform (10) having a support frame (12), a support tool (13) arranged on the support frame (12), the support tool (13) operable to engage a lubricator (14) and vertically and horizontally support the lubricator (14), wherein the support frame (12) is movable between an advanced position and a retracted position. There is also provided an assembly for carrying out well operations comprising a wireline mast (11), and methods of inserting and retrieving a tool string into or from a well pipe (15).

22 Claims, 2 Drawing Sheets

(51) Int. Cl.
*E21B 19/00* (2006.01)
*E21B 19/16* (2006.01)

(56) References Cited

U.S. PATENT DOCUMENTS

| | | | | |
|---|---|---|---|---|
| 2015/0315861 | A1 | 11/2015 | Zachariasen | |
| 2016/0348448 | A1* | 12/2016 | Miller, Jr | E21B 19/084 |
| 2019/0242194 | A1 | 8/2019 | Toma | |
| 2020/0011141 | A1* | 1/2020 | Wijning | E21B 19/09 |

FOREIGN PATENT DOCUMENTS

| | | | |
|---|---|---|---|
| NO | 342128 | B1 * | 3/2018 |
| WO | 2009/001088 | A1 | 12/2008 |
| WO | 2011/135541 | A2 | 11/2011 |

OTHER PUBLICATIONS

PCT/NO2021/050055, International Search Report and Written Opinion, dated May 21, 2021; 11 pages.
NO20200252, Norwegian Search Report, dated Aug. 7, 2020; 2 pages.
NO20200252, Norwegian Search Report, dated Feb. 7, 2021; 4 pages.

* cited by examiner

WORK PLATFORM AND METHOD FOR WELL OPERATIONS

The present invention relates to a work platform and associated methods, and particularly to a work platform and methods for well operations.

BACKGROUND

During petroleum production, downhole well operations may from time to time be required, for example for well intervention purposes. Such downhole operations are often carried out using tool strings suspended by a wireline or coiled tubing.

In these operations, the tools and equipment used therefor are usually handled by a combination of machines, such as cranes or winches, and human operators.

In most petroleum-related activities, there is a continued need for safer and more efficient systems and methods for carrying out operations, particularly such operations involving manual intervention and human operators.

The present disclosure has the objective to provide improvements, or at least alternatives, to the state of the art in the above or other areas.

SUMMARY

In an embodiment, there is provided a work platform for use in well operations, the work platform being configured for positioning above a well pipe, the work platform having a support frame, a support tool arranged on the support frame, the support tool operable to engage a lubricator and vertically and horizontally support the lubricator, wherein the support frame is movable between an advanced position and a retracted position.

In the advanced position, the support tool may support the lubricator in a position which intersects a well centre line extending through the well pipe and in the retracted position the support tool may support the lubricator in a position which is spaced horizontally from the well centre line.

The support tool may be operable to vertically and horizontally support the lubricator while moving the lubricator between the advanced position and the retracted position.

The support frame may be movable between the advanced position and the retracted position along a horizontal axis.

In the advanced position, the support tool may be positioned in a well centre line extending through the well pipe and in the retracted position the support tool may be spaced horizontally from the well centre line.

The work platform may be configured for being fixed to and supported by the well pipe.

The work platform may be configured for being supported by a deck.

The work platform may comprise a workfloor for a human operator.

The workfloor may comprise foldable workfloor sections.

The support frame may comprise an actuator operable to move the support tool vertically in relation to the support frame.

The support tool may comprise a clamp or a gripper tong.

The support tool may comprise a spinner tong operable to rotate the lubricator when engaged.

The work platform may be configured for use with a wireline mast operable to suspend the lubricator, whereby, in use, the work platform is positioned adjacent the wireline mast above the well pipe.

The work platform may be structurally independent from the wireline mast.

The work platform may be configured for use without a wireline mast above the well pipe.

The work platform may be configured for use both with and without a wireline mast.

In an embodiment, there is provided an assembly for carrying out well operations, the assembly comprising a wireline mast, a lubricator and a work platform.

In an embodiment, there is provided a method of inserting a tool string into a well pipe, the method comprising the steps: hanging off a lower part of the tool string in the well pipe; by means of a work platform having a movable support frame comprising a support tool, operating the support tool to vertically and horizontally support a lubricator comprising an upper part of the tool string in a position above the well pipe; while supporting the lubricator in the position above the well pipe with the support tool, connecting the upper and lower parts of the tool string; and connecting the lubricator to the well pipe.

The method may further comprise the step of, while supporting the lubricator with the support tool, moving the lubricator from a position spaced from a well centre line extending through the well pipe to a position which intersects the well centre line.

The step of connecting the upper and lower parts of the tool string may be carried out by a human operator.

In an embodiment, there is provided a method of retrieving a tool string from a well pipe, the method comprising the steps: by means of a work platform having a movable support frame comprising a support tool, operating the support tool to vertically and horizontally support a lubricator comprising an upper part of the tool string in a position above the well pipe; disconnecting a lubricator from the well pipe; and while supporting the lubricator in the position above the well pipe with the support tool, disconnecting the upper part of the tool string from a lower part of the tool string.

The method may further comprise the step of, while supporting the lubricator with the support tool, moving the lubricator from a position which intersects a well centre line extending through the well pipe to a position spaced from the well centre line.

The step of disconnecting the upper part of the tool string from a lower part of the tool string may be carried out by a human operator.

Any of the methods may further comprise supporting the lubricator by a hoisting wire while supporting the lubricator with the support tool.

In any of the methods, the work platform may be a work platform as described or claimed elsewhere in this disclosure. Any of the methods may comprise operating the work platform, or individual components thereof, as described in this disclosure.

Further aspects will become apparent from the detailed description given below in conjunction with the appended drawings.

BRIEF DESCRIPTION OF THE DRAWINGS

These and other characteristics will become clear from the following description of illustrative embodiments, given as non-restrictive examples, with reference to the attached drawings, in which.

DETAILED DESCRIPTION

Figure 1:
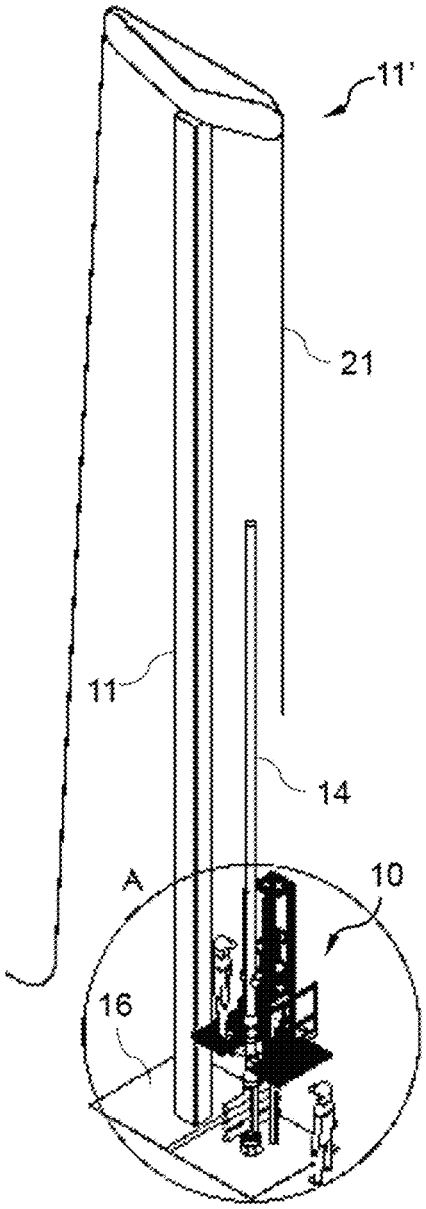
FIG. 1 is a perspective view of a wireline mast and associated components, including a work platform for use with a wireline mast.

Aspects of the present disclosure will become apparent from the detailed description given below. The detailed description and specific examples disclose preferred embodiments of the disclosure by way of illustration only. Those skilled in the art understand from guidance in the detailed description that changes and modifications may be made within the scope of the disclosure.

Hence, it is to be understood that the herein disclosed disclosure is not limited to the particular component parts of the device described or steps of the methods described since such device and method may vary. It is also to be understood that the terminology used herein is for purpose of describing particular embodiments only, and is not intended to be limiting. It should be noted that, as used in the specification and the appended claim, the articles "a", "an", "the", and "said" are intended to mean that there are one or more of the elements unless the context explicitly dictates otherwise. Thus, for example, reference to "a unit" or "the unit" may include several devices, and the like. Furthermore, the words "comprising", "including", "containing" and similar wordings does not exclude other elements or steps.

The present description provides an improved work platform for use with wireline mast. According to an example embodiment there is provided a work platform for use with a wireline mast. The work platform may be configured for positioning above a well pipe adjacent the wireline mast. The work platform has a support frame and a support tool arranged on the support frame, the support tool being operable to engage a lubricator suspended from the wireline mast and vertically and horizontally support the lubricator, wherein the support frame is movable between an advanced position and a retracted position.

In well operations, there is commonly a need for regular well intervention or servicing. This is typically carried out using a tool string (also known as a bottom hole assembly, BHA), which is suspended by a flexible pipe (so-called coiled tubing) or a wireline. The tool string will, as is known in the art, be introduced into the well via a lubricator. During a well intervention operation, there may be a need to retrieve and re-insert the tool string several times, to complete all necessary downhole tasks. It is therefore desirable that these operations can be carried out efficiently, in order to minimise the time required for the overall operation. At the same time, there is a requirement that these operations be carried out safely and with minimised risk to equipment and personnel.

Often, the tool string has a length which necessitates splitting it during insertion or retrieval, as the lubricator may not have a length which is sufficient to allow the entire tool string to be retrieved fully into the lubricator. In such cases, the lubricator will be broken out, a lower part of the tool string will be hung off in the well pipe, and the tool string will be split and retrieved in parts.

Figure 2:
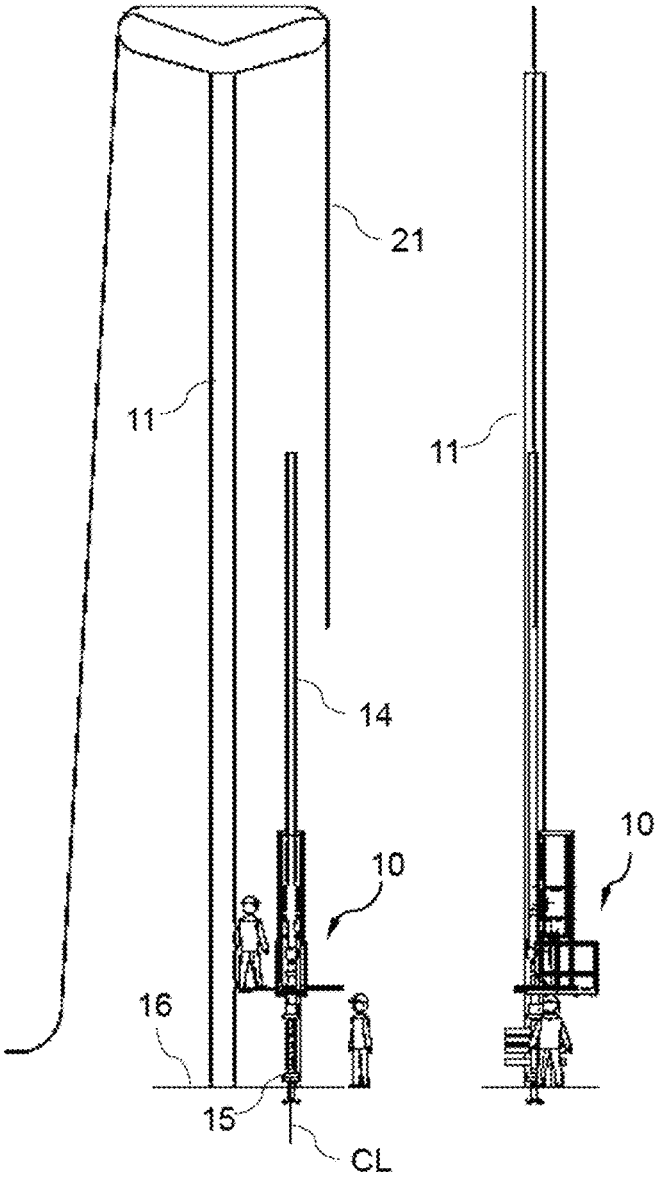
FIG. 2 shows side views of the wireline mast of FIG. 1.
Figure 3:
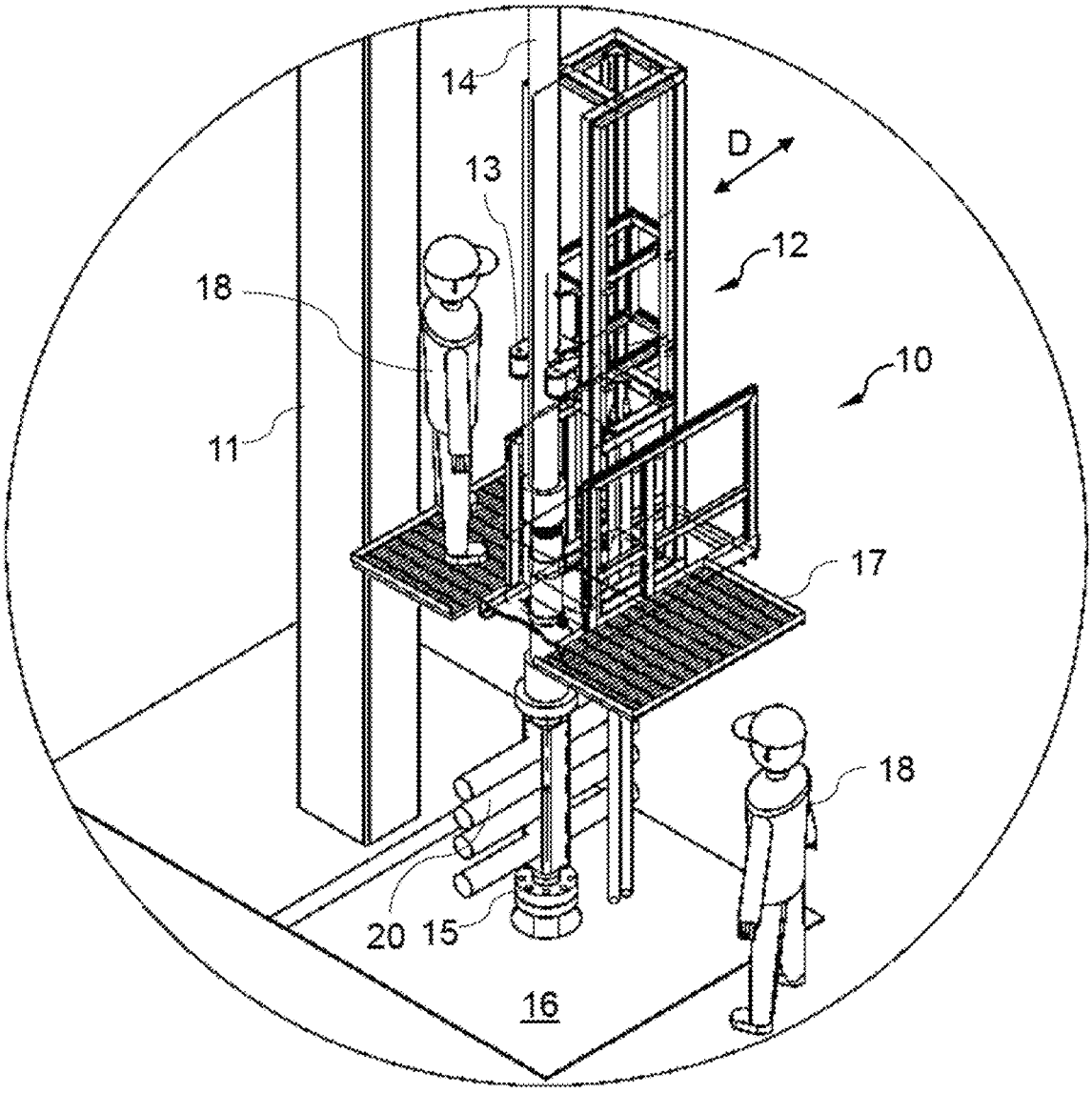
FIG. 3 shows details of the work platform for use with a wireline mast as shown in FIG. 1.

FIGS. 1-3 illustrate an example setup according to an embodiment of the present disclosure. FIGS. 1-3 show a work platform 10 for use with a wireline mast 11. The wireline mast 11 may be a conventional mast or tower used for wireline operations, for example on offshore petroleum platforms. The mast 11 conventionally comprises one or more hoisting wires 21 extending via sheaves (not shown) arranged in a top section 11' of the mast, for hoisting and suspending items during the wireline operation. The wireline used for suspending the tool string is also arranged via the top section 11' of the mast 11. Winches (not shown) can be arranged on the deck 16, operatively connected to the hoisting wire(s) 21 and the wireline.

The work platform 10 is configured for positioning above a well pipe 15 (see FIGS. 2 and 3) extending downwardly to a subterranean reservoir (not shown). The well pipe 15 may conventionally extend towards the reservoir via a riser, a valve tree and a wellhead. A blow out preventer 20 may be arranged in the well pipe 15. The blow out preventer 20 and the riser may be temporarily arranged on the valve tree for the purpose of a downhole intervention operation.

The work platform is arranged adjacent the wireline mast 11 during the wireline operations. The work platform 10 has a support frame 12 and a support tool 13 arranged on the support frame 12. The support tool 13 is operable to engage a lubricator 14 suspended from the wireline mast 11 and vertically and horizontally support the lubricator 14. For this purpose, the support tool 13 can, for example, comprises a clamp or a gripper tong which can engage the outer surface of the lubricator 14 and hold the lubricator 14 fixed. In this manner, the support tool 13 both holds the lubricator 14 fixed in the horizontal plane, and supports the lubricator 14 vertically, i.e. supports the weight of the lubricator 14 or part of the weight thereof. The support tool 13 can for this purpose be arranged with a sufficient gripping force or friction surface to be able to hold a vertical force, and/or the lubricator 14 may be arranged with recesses or protrusions such that the support tool 13 can engage a non-vertical face of the lubricator 14 outer surface for holding a vertical force.

When the tool string needs to be split (during retrieval) or made up (during run-in), the support tool 13 can thus be engaged to hold the lubricator 14 both horizontally and vertically. This provides the advantage that the lubricator 14 is prevented from moving vertically when a human operator 18 (see FIG. 3) is carrying out operations for hanging off, splitting, or assembling the tool string in the gap between the (split) lubricator parts, or between the lubricator 14 and the well pipe 15. As the lubricator 14 is held fixed also by the support tool 13 in the support frame 12, the lubricator 14 is not suspended merely by a hoisting wire 21 in the mast 11, but is additionally secured against undesired movement when the operator 18 is doing work on the tool string, e.g. a failure of the hoisting system or a hoisting wire 21 which may result in the lubricator 14 falling/dropping.

The support tool 13 may comprise a spinner tong operable to rotate the lubricator 14 when engaged. This may allow the support tool 13 to assist spinning out or spinning in the lubricator parts during make-up or breaking out the lubricator 14. A spinner tong may, for example, be arranged in addition to a clamp or gripper tong, or on its own and arranged to also hold and fix the lubricator 14 horizontally and vertically.

The support frame 12 is movable on the work platform 10 between an advanced position and a retracted position along a horizontal axis D (see FIG. 3). In the advanced position, the support tool 13 is positioned in a well centre line CL (indicated in FIG. 2) which extends through the well pipe 15, and in the retracted position the support tool 13 is spaced horizontally from the well centre line CL. FIGS. 1-3 illustrate the advanced position, wherein the support tool 13 can engage the lubricator 14 which is positioned directly above the well pipe 15 in the well centre line CL.

By providing the support frame 12 movable on the work platform 10, it can be retracted when not in use, for example after make-up of the lubricator 14, when the wireline operation is ongoing, or before the lubricator 14 has been hoisted in place before the start of a wireline operation.

Optionally, the movable support frame 12 may also be used to support the lubricator 14 after break-out, by keeping the lubricator 14 fixed in the support tool 13 and retracting the support frame 12 such that the lower part of the lubricator 14 is moved away from the well centre line CL. This can be done after the lubricator 14 has been broken out and after the tool string has been split and the lower part of the tool string hung off in the well pipe 15. The lubricator 14 can then be moved out of the well centre line CL such that the lower part of the tool string can be hoisted out of the well pipe 15.

The work platform 10 may optionally comprise a workfloor 17 for the human operator 18. This can allow the operator 18 to work directly adjacent the lower part of the lubricator 14, in the event that the height of the well pipe 15 and/or the blow out preventer 20 would otherwise make this difficult.

Advantageously, the work platform 10 is made structurally independent from the wireline mast 11. This allows the work platform 10 to be used with different wireline masts, not being dependent on a particular mast design. The work platform 10 may be made modular and movable for this purpose, such that it can be used on different wells and/or on different locations. Optionally, for this purpose, the workfloor 17 can be made collapsible by means of foldable workfloor sections. This may be done, for example, by fixing the workfloor sections to the rest of the work platform 10 via hinges.

The work platform 10 may be configured for being fixed to and supported by the well pipe 15 itself, and/or by the blow out preventer 20. This can avoid the need for a dedicated support structure for the work platform 10 and ensure that the work platform 10 is arranged at the correct height and location in relation to the well pipe 15.

Alternatively (or additionally), the work platform 10 can be configured for being supported on the deck 16. This can, for example, be done via support legs extending from the work platform 10 to the deck 16. Such support legs may be height-adjustable in order that the work platform 10 can be positioned at the correct height in relation to the well pipe 15.

Optionally, the support frame 12 comprises an actuator operable to move the support tool 13 vertically in relation to the support frame 12. This may, for example, be realised by arranging the support tool 13 or rails or by other means arranging the support tool 13 vertically movable in relation to the support frame 12, and providing an actuator to control the vertical position of the support tool 13 in relation to the support frame 12. The actuator may, for example, be a linear hydraulic actuator, a threaded rod arrangement, or any other suitable actuation arrangement. This can allow the support tool 13 to provide a lifting force on the lubricator 14, for example to lift the lubricator 14 during break-out and/or to assist in the positioning of the lubricator 14 relative to the well pipe 15 during make-up. Such vertical actuation of the support tool 13 may provide more secure or more accurate vertical movement of the lubricator 14 than the hoisting system via the wireline mast 11.

Optionally, the work platform 10 may be configured for use without a wireline mast 11 above the well pipe 15. The work platform 10 may in such a case be employable also without the wireline mast 11, for example if an operation only requires a short lubricator 14 which can be hoisted or moved in place without a wireline mast 11.

Advantageously, the work platform 10 is configured for use both with and without the wireline mast 11. This can be done by designing the work platform 10 to be independent of the wireline mast 11, and for example being supported on the deck 16 or on the well pipe 15.

The invention is not limited by the embodiments described above; reference should be had to the appended claims. Modifications and variations are possible within the scope of the claims, as will be understood by the skilled person in practicing the claimed disclosure, from a study of the drawings, the disclosure, and the appended claims.

The invention claimed is:

1. A work platform for use with a wireline mast in well operations, the wireline mast comprising one or more hoisting wires for hoisting and suspending a lubricator, the work platform configured for positioning above a well pipe, the work platform comprising:

a support frame; and a support tool arranged on the support frame, wherein:

the support tool is operable to engage the lubricator;

the support tool is operable to support and fix the lubricator vertically and horizontally independently of the wireline mast and hoisting wires; and the support frame is movable between an advanced position and a retracted position relative to the well pipe and wireline mast.

2. The work platform of claim 1, wherein:

in the advanced position, the support tool supports and fixes the lubricator in a position which intersects a well centre line extending through the well pipe, and in the retracted position, the support tool supports and fixes the lubricator in a position which is spaced horizontally from the well centre line.

3. The work platform of claim 1, wherein the support tool is operable to vertically and horizontally support and fix the lubricator while moving the lubricator between the advanced position and the retracted position.

4. The work platform of claim 1, wherein the support frame is movable between the advanced position and the retracted position along a horizontal axis.

5. The work platform of claim 1, wherein:

in the advanced position, the support tool is positioned in a well centre line extending through the well pipe, and in the retracted position, the support tool is spaced horizontally from the well centre line.

6. The work platform of claim 1, wherein the work platform is fixed to and supported by the well pipe.

7. The work platform of claim 1, wherein the work platform is supported by a deck.

8. The work platform of claim 1, wherein the work platform comprises a workfloor for a human operator.

9. The work platform of claim 8, wherein the workfloor comprises foldable workfloor sections.

10. The work platform of claim 1, wherein the support frame comprises an actuator operable to move the support tool vertically in relation to the support frame.

11. The work platform of claim 1, wherein the support tool comprises a clamp or a gripper tong.

12. The work platform of claim 1, wherein the support tool comprises a spinner tong operable to rotate the lubricator when engaged.

13. The work platform of claim 1, wherein the work platform is positioned adjacent the wireline mast above the well pipe.

14. An assembly for carrying out well operations comprising:

the work platform of claim 1;

the wireline mast; and the lubricator.

15. A method of inserting a tool string into a well pipe, comprising:

providing a work platform comprising:

a support frame movable between an advanced position and a retracted position; and a support tool arranged on the support frame;

hanging off a lower part of the tool string in the well pipe;

operating, by means of the work platform, the support tool to engage a lubricator, wherein:

the support tool supports and fixes the lubricator vertically and horizontally; and the lubricator comprises an upper part of the tool string in a position above the well pipe;

connecting, while supporting and fixing the lubricator in the position above the well pipe with the support tool, the upper part of the tool string and the lower part of the tool string; and connecting the lubricator to the well pipe.

16. The method of claim 15, further comprising:

moving, while supporting and fixing the lubricator with the support tool, the lubricator from a position spaced from a well centre line extending through the well pipe to a position which intersects the well centre line.

17. The method of claim 15, wherein the work platform comprises a workfloor for a human operator.

18. The method of claim 15, wherein the support frame is movable between the advanced position and the retracted position along a horizontal axis.

19. A method for retrieving a tool string from a well pipe, comprising;

providing a work platform comprising a support frame movable between an advanced position and a retracted position; and a support tool arranged on the support frame;

operating, by means of the work platform, the support tool to engage a lubricator, wherein:

the support tool supports and fixes the lubricator vertically and horizontally; and the lubricator comprises an upper part of the tool string in a position above the well pipe:

disconnecting the lubricator from the well pipe; and disconnecting, while supporting and fixing the lubricator in the position above the well pipe with the support tool, the upper part of the tool string from a lower part of the tool string.

20. The method of claim 19, further comprising:

moving, while supporting and fixing the lubricator with the support tool, the lubricator from a position which intersects a well centre line extending through the well pipe to a position spaced from the well centre line.

21. The method of claim 19, wherein the work platform comprises a workfloor for a human operator.

22. The method of claim 19, further comprising supporting the lubricator by a hoisting wire while supporting and fixing the lubricator with the support tool.

* * * * *